US005469244A

United States Patent [19]

Ogata et al.

[11] Patent Number: 5,469,244

[45] Date of Patent: Nov. 21, 1995

[54] DEVELOPING AGENT DENSITY CONTROL METHOD OF VARYING DEVELOPMENT BIAS IN DENSITY CONTROL

[75] Inventors: Takao Ogata, Yokohama; Takeshi Menjo, Tokyo, both of Japan

[73] Assignee: Canon Kabushiki Kaisha, Tokyo, Japan

[21] Appl. No.: 209,256

[22] Filed: Mar. 14, 1994

[30] Foreign Application Priority Data

Mar. 19, 1993 [JP] Japan ..... 5-085407

[51] Int. Cl.[6] ..... G03G 21/00

[52] U.S. Cl. ..... 355/246; 355/203

[58] Field of Search ..... 355/203, 208, 355/214, 246; 118/689–691

[56] References Cited

U.S. PATENT DOCUMENTS 4,272,182 6/1981 Abe et al. ..... 355/246
4,632,537 12/1986 Imai ..... 355/203
4,883,019 11/1989 Menjo et al. ..... 118/691
5,253,018 10/1993 Takeuchi et al. ..... 355/246

*Primary Examiner*—William J. Royer
*Attorney, Agent, or Firm*—Fitzpatrick, Cella, Harper & Scinto

[57] ABSTRACT

A developing agent density control method includes the steps of forming a density control latent image with a predetermined potential on an image carrier, developing the density control latent image by applying a density control development bias and using a two-component developing agent having a toner and a carrier, sensing the density of the density control image, and controlling a toner-to-carrier ratio on the basis of the sensed density. In this method, the density control development bias is different from a print development bias.

6 Claims, 9 Drawing Sheets

DEVELOPING AGENT DENSITY CONTROL METHOD OF VARYING DEVELOPMENT BIAS IN DENSITY CONTROL

BACKGROUND OF THE INVENTION

1. Field of the Invention

The present invention relates to a developing agent density control method of controlling a toner-to-carrier ratio for use in an image forming apparatus which develops a latent image formed on an image carrier by using a two-component developing agent consisting of a toner and a carrier.

2. Description of the Related Art

FIG. 15 illustrates an image forming apparatus which relates to the present invention.

In the image forming apparatus shown in FIG. 15, a photosensitive drum 1 which is rotatably supported to rotate in a direction indicated by an arrow is evenly charged by a primary charger 2. Subsequently, a color-separated light image 3 is radiated thereon to form an electrostatic latent image on the photosensitive drum 1.

The electrostatic latent image formed on the photosensitive drum 1 is then developed into a toner image by moving a predetermined one of a plurality of developing units 5 (5M, 5C, 5Y, and 5B), which are mounted on a moving table 7 and conveyed in the direction of a tangent line of the photosensitive drum 1, to a developing section, i.e., a developing position 4, and by applying a development bias from a development bias voltage source 6.

The resultant toner image on the photosensitive drum 1 is transferred by a transfer charger 9 onto a transfer material which is supplied from a transfer material cassette 20 to a transfer drum 8.

While the transfer charger 9 is OFF, a patch image with a predetermined density is formed on the photosensitive drum 1 by the same development bias as that during printing in order to perform density sensing. As shown in FIG. 16, a sensor constituted by a light-emitting element 51, an optical transparent window 52, a light-receiving element 53, and a light-receiving element 54 for monitoring direct light from the light-emitting element 51 senses the density of the patch image, and a CPU 55 performs calculations in accordance with the sensed density. On the basis of the calculation result, the CPU 55 replenishes a developing unit with a toner if necessary, thereby performing control such that the image density is kept constant.

The toner image and the patch image not transferred but remaining on the photosensitive drum 1 are removed from the photosensitive drum 1 by a cleaning unit 10. The photosensitive drum 1 is then used in the formation of the next image.

In the apparatus of the above sort, the image density preferably varies little during printing due to a variation in the mixing ratio of the toner to the carrier.

For this reason, the developing agent density variation does not appear easily as the image density variation. Consequently, although the developing agent density control is performed, the developing agent density variation becomes large to result in unstable image formation.

SUMMARY OF THE INVENTION

It is an object of the present invention to provide a developing agent density control method which decreases a variation in developing agent density.

It is another object of the present invention to provide a developing agent density control method which can stabilize an image density and prevent scattering and fog of a toner.

It is still another object of the present invention to provide a developing agent density control method comprising the steps of:

forming a density control latent image with a predetermined potential on an image carrier;

developing the density control latent image by applying a density control development bias and using a two-component developing agent having a toner and a carrier;

sensing the density of the density control image; and controlling a toner-to-carrier ratio on the basis of the sensed density, wherein the density control development bias is different from a print development bias.

Other objects of the present invention will become apparent from the following detailed description of the invention.

DETAILED DESCRIPTION OF THE PREFERRED EMBODIMENTS

A developing agent density control method according to the present invention will be described in detail below with reference to the accompanying drawings.

Embodiment 1

Figure 1:
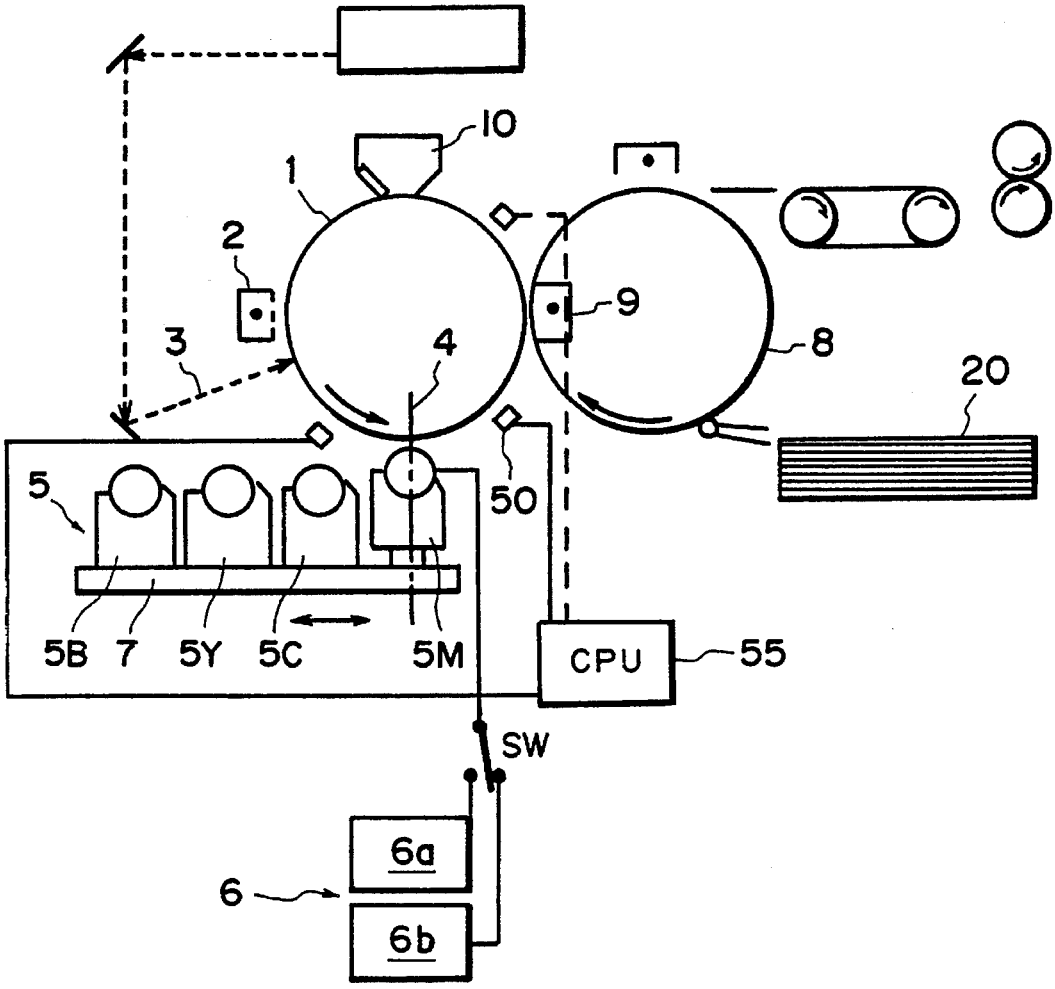
FIG. 1 is a schematic view showing the arrangement of one embodiment of an image forming apparatus to which a developing agent density control method according to the present invention is applied.

FIG. 1 shows one embodiment of an image forming apparatus to which the developing agent density control method of the present invention is applied. This image forming apparatus has the same arrangement and operation as those of the image forming apparatus explained earlier with reference to FIG. 15. Therefore, the same reference numerals as in FIG. 15 denote the parts having the same functions and operations in FIG. 1, and a detailed description thereof will be omitted.

Figure 15:
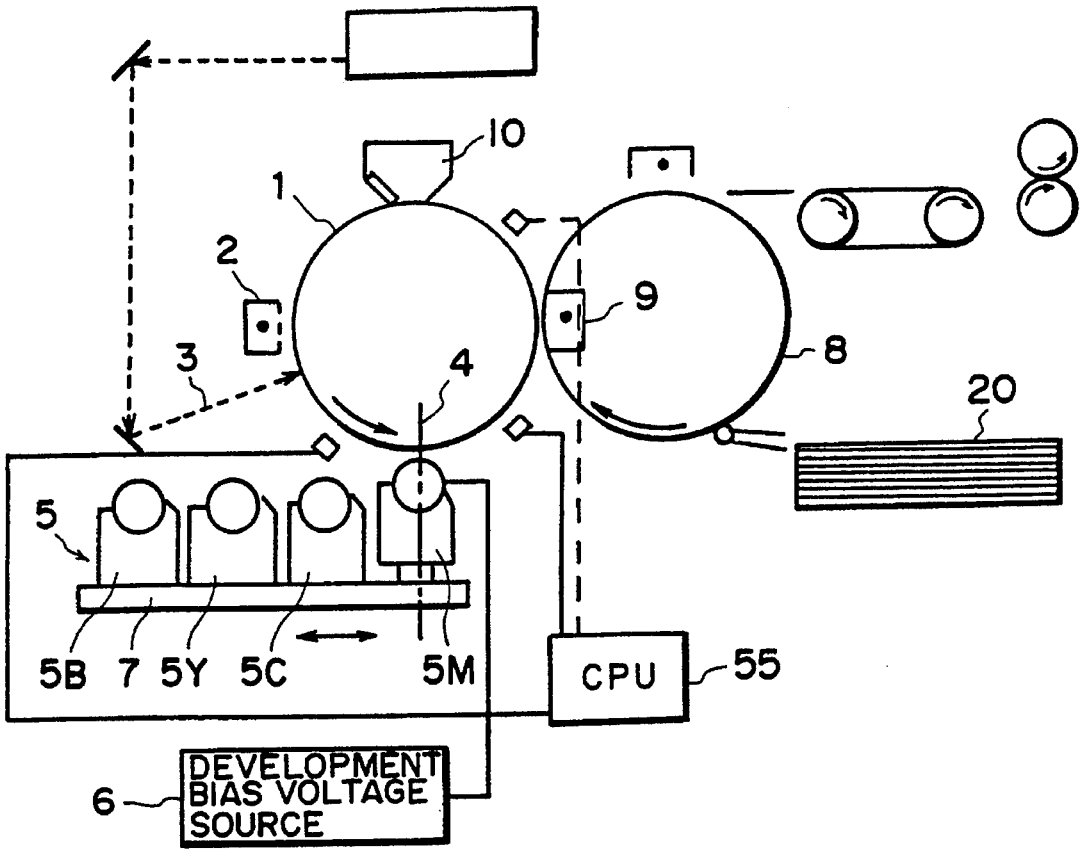
FIG. 15 is a schematic view showing the overall arrangement of an image forming apparatus.

In this embodiment, as in the example illustrated in FIG. 15, a print operation is performed by developing an electrostatic latent image which is formed on a photosensitive drum 1 into a toner image by applying a print development bias from a development bias voltage source **6*a* by moving a developing unit 5 to a development position 4. When the latent image of a patch image for controlling a developing agent density is formed, the development bias voltage source 6*a* is switched to a development bias voltage source 6*b*** by a switch SW. Consequently, a density control development bias which is different from the print development bias is applied to the developing unit, thereby making the density control latent image for the patch image into a visible image.

Figure 16:
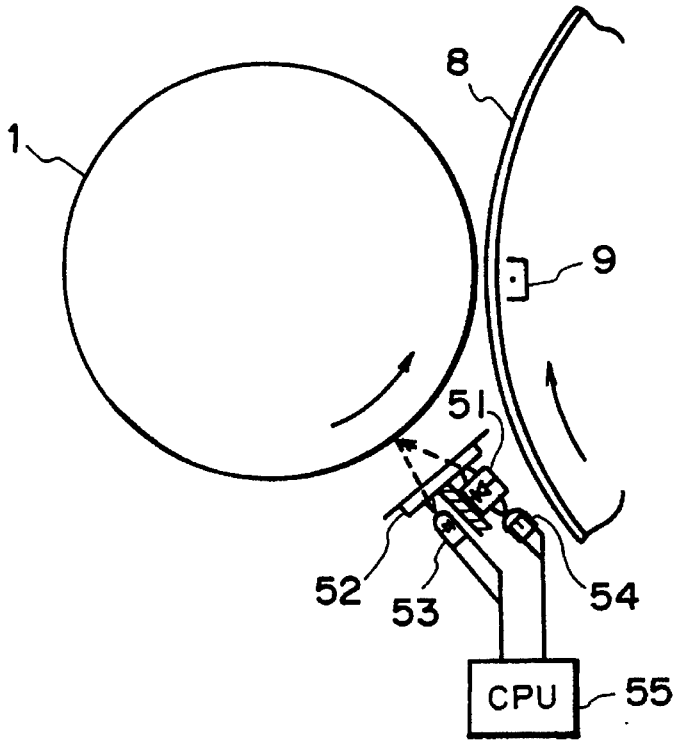
FIG. 16 is a view showing the details of a density sensor.

The details of a sensor 50 are identical with those shown in FIG. 16.

The density of the patch image which is developed with a toner is optically sensed by the sensor 50.

A CPU 55 compares the idensity sensed by the sensor 50 with a reference density. If the sensed density is lower than the reference density, a predetermined amount of toner obtained by calculation is supplied, thereby keeping the developing agent density constant.

Figure 2:
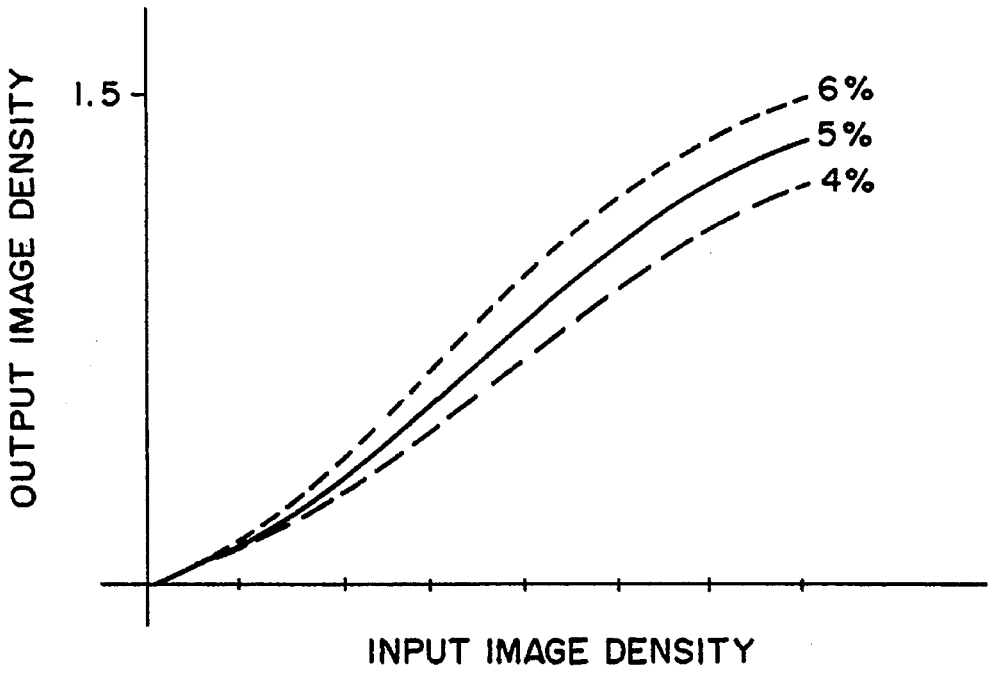
FIG. 2 is a graph showing the output image density as a function of the input image density when a rectangular wave (2 KHz, 2 KVpp) is used as a development bias.
Figure 3:
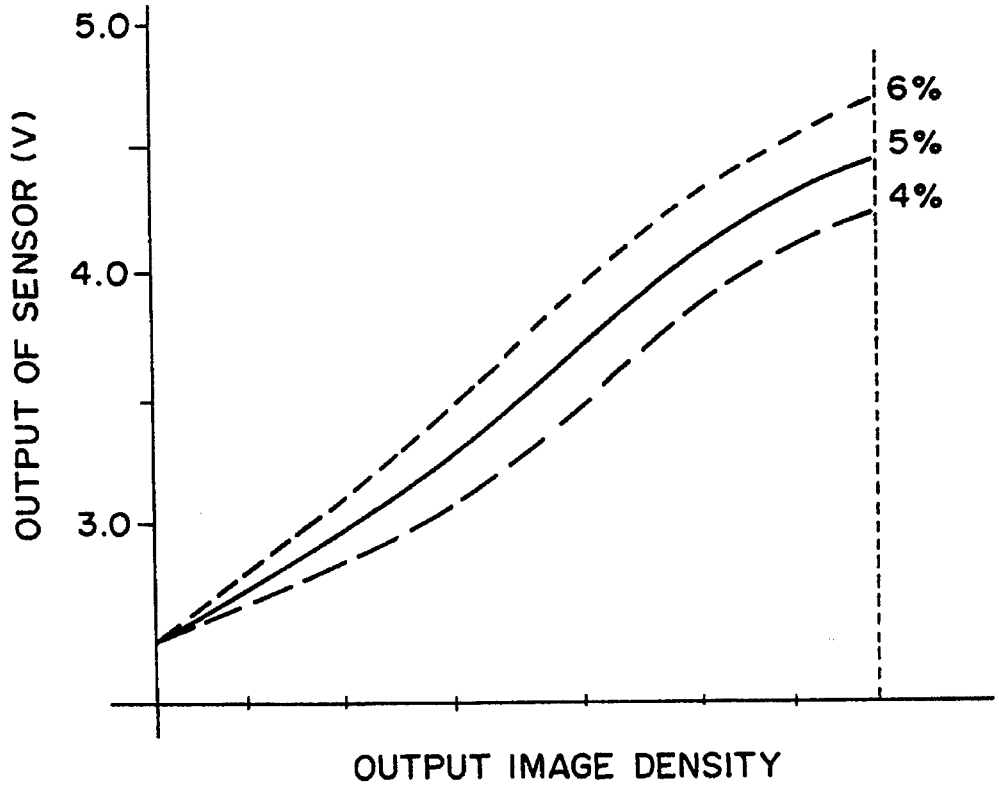
FIG. 3 is a graph showing the output from a density sensor as a function of the output image density when the rectangular wave (2 KHz, 2 KVpp) is used as a development bias.

In this apparatus, the development bias voltage source 6a outputs a rectangular wave of 2 KHz and 2 KVpp as an AC component, and the print development bias is generated by superposing a DC component onto this AC component. FIGS. 2 and 3 illustrate the development characteristics obtained under these conditions.

Note that the 4%, 5%, and 6% curves shown in FIGS. 2 and 3 correspond to the weight ratios of a toner contained in a two-component developing agent (a toner and a carrier).

FIG. 2 is a graph showing the output image density as a function of the input image density, and FIG. 3 is a graph showing the output from the density sensor 50 at that time. As can be seen from FIG. 3, the sensitivity at which the developing agent density is sensed is approximately 200 mV/wt %.

Figure 10:
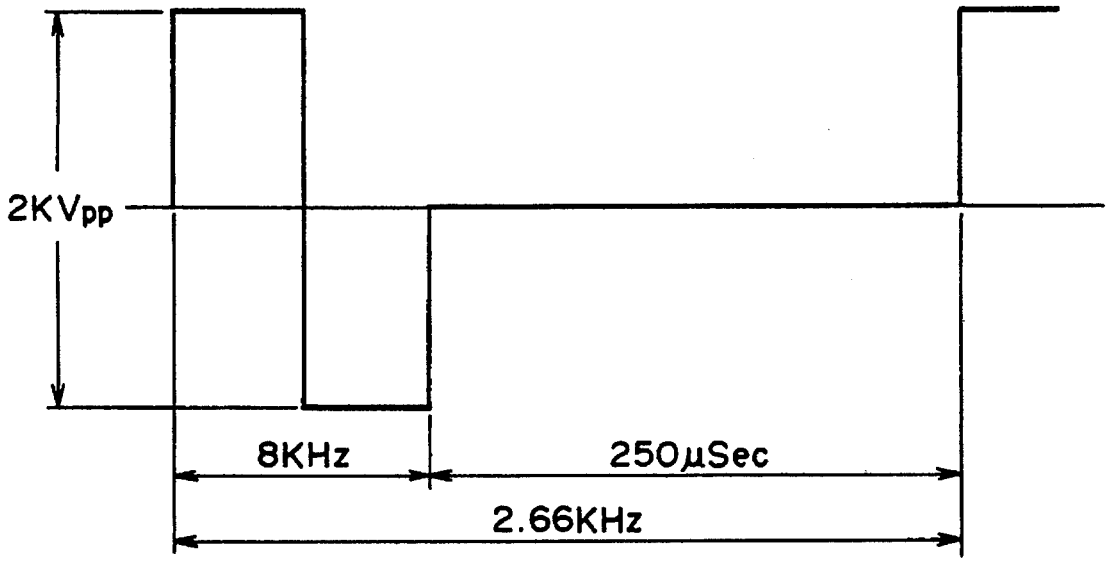
FIG. 10 is a view showing a waveform which intermittently forms an alternating field.

The development bias voltage source **6*b* for density control outputs a bias waveform, as shown in FIG. 10**, in which an alternating field is formed intermittently. That is, in this embodiment, the characteristics of the development bias waveform are:

| | |
|---|---|
| Total frequency | 2.66 KHz |
| Rectangular part | 8 KHz |
| Blank part | 250 μsec |
| Peak-to-peak | 2 KVpp |

This development bias waveform increases the development efficiency to make development at a low contrast possible. That is, a maximum density of 1.5 could be obtained by a voltage that is about 100 V lower than a contrast potential required to obtain this maximum density of 1.5 when a normal rectangular wave (2 KHz, 2 KVpp) is used.

Figure 4:
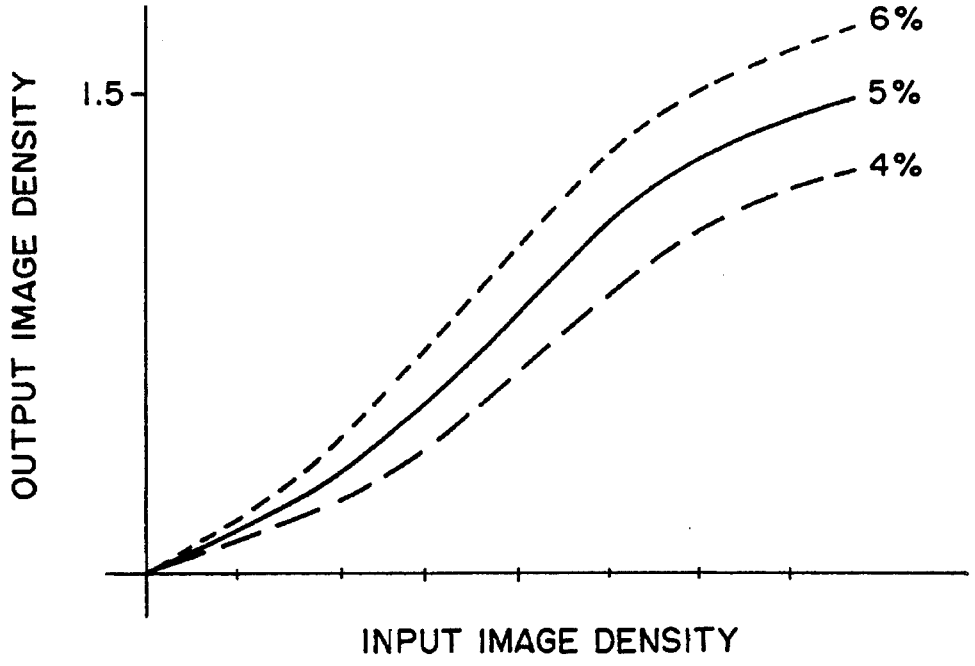
FIG. 4 is a graph showing the output image density as a function of the input image density when a waveform which intermittently forms an alternating field is used as a development bias.
Figure 5:
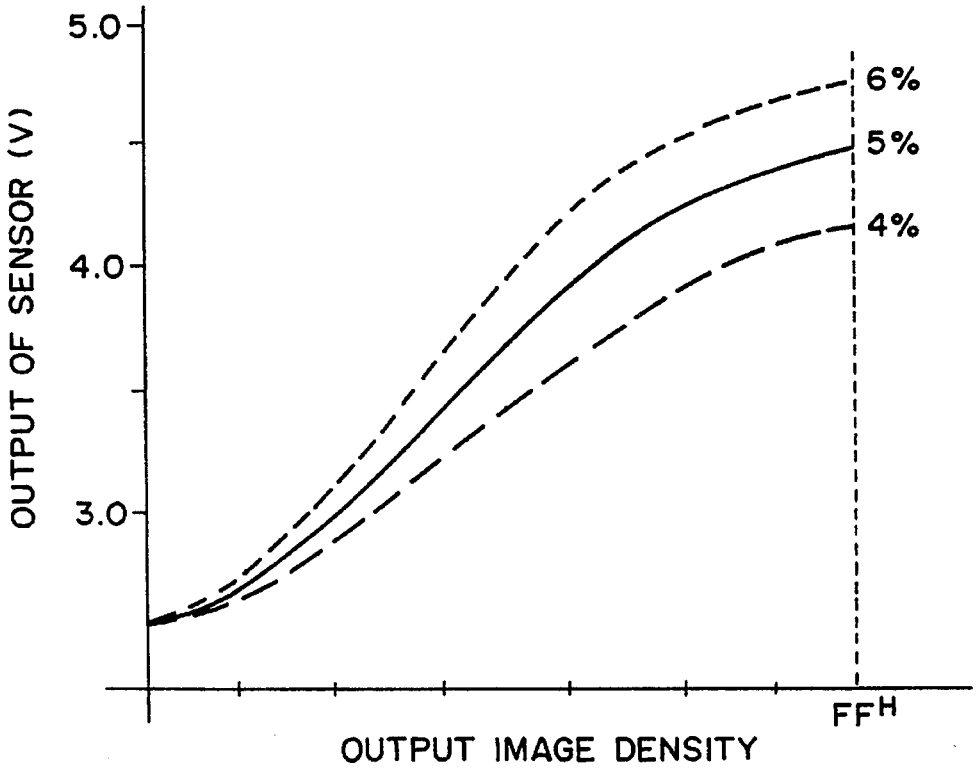
FIG. 5 is a graph showing the output from a density sensor as a function of the output image density when a waveform which intermittently forms an alternating field is used as a development bias.

FIG. 4 is a graph showing the output image density as a function of the input image density, and FIG. 5 is a graph showing the output from the density sensor at that time. As can be seen by comparing FIGS. 4 and 5 with FIGS. 2 and 3 illustrating the results obtained by the print development bias, the development bias at the time the patch image is formed increases the variation in the output image density with respect to the developing agent density. That is, an image density variation (sensitivity) with respect to a developing agent density variation of 1 wt % is as large as about 300 mV/wt %.

When the above development bias waveform was used as the development bias for forming the patch image for developing agent density control, the developing agent density variation decreased, and scattering and fog of the toner also decreased.

Embodiment 2

In Embodiment 2, image formation was performed by using the same image forming apparatus as in Embodiment 1.

Figure 6:
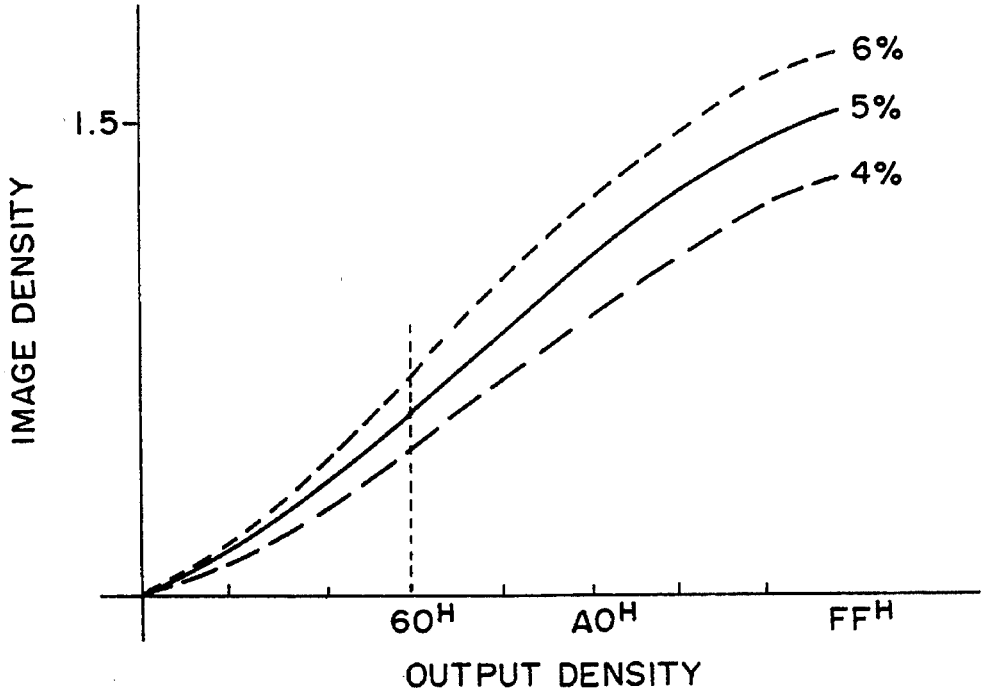
FIG. 6 is a graph showing the output image density as a function of the input image density when a carbon-containing toner is used and a rectangular wave (2 KHz, 2 KVpp) is used as a development bias.
Figure 8:
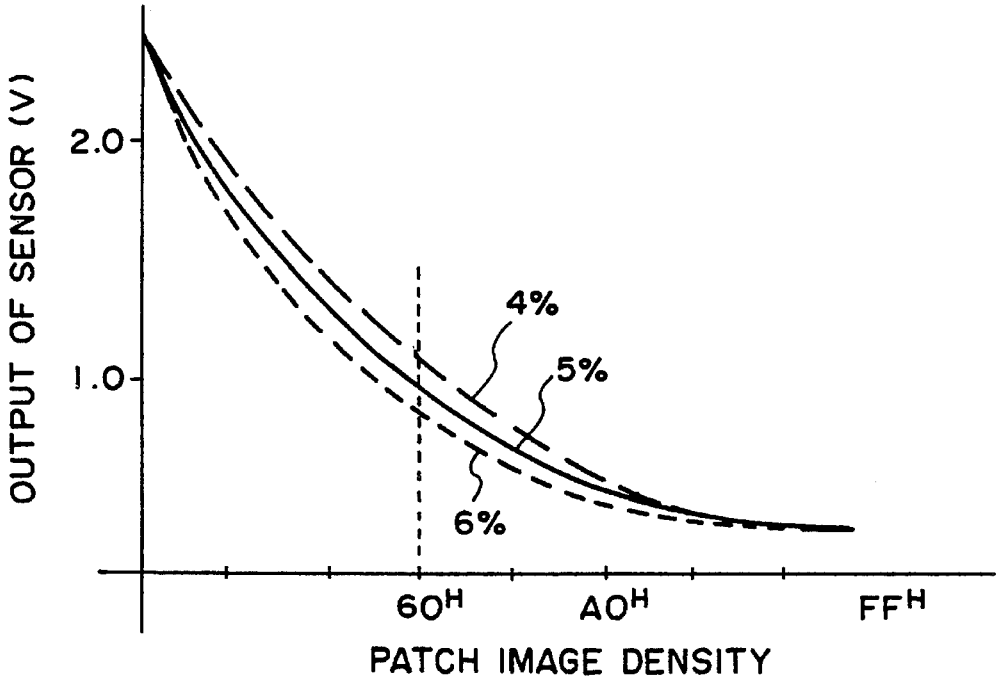
FIG. 8 is a graph showing the output from a density sensor as a function of the output image density when a carbon-containing toner is used and the rectangular wave (2 KHz, 2 KVpp) is used as a development bias.

In this embodiment, a print development bias voltage source **6*a* outputs a development bias formed by superposing a DC component onto a rectangular wave of 2 KHz and 2 KVpp as an AC component. The resultant development characteristics are illustrated in FIGS. 6 and 8. FIG. 6 is a graph showing the output image density as a function of the input image density, and FIG. 8 is a graph showing the output from a density sensor 50** at that time. In this embodiment, a black toner containing carbon was used.

In the development using the development bias with a high gradation reproducibility as illustrated in FIG. 6, a sensor output difference (sensitivity) for density control of only about 140 mV/wt % could be obtained with respect to an output difference in a developing agent density of 1 wt % as shown in FIG. 8.

The toner containing carbon absorbs light emitted by a light-emitting element. Therefore, the sensitivity decreases as the image density increases, and this makes it impossible to sense the image density difference and the developing agent density difference.

A development bias voltage source **6*b*** superposes AC and DC voltages to output a rectangular wave of 8 KHz and 2

Figure 7:
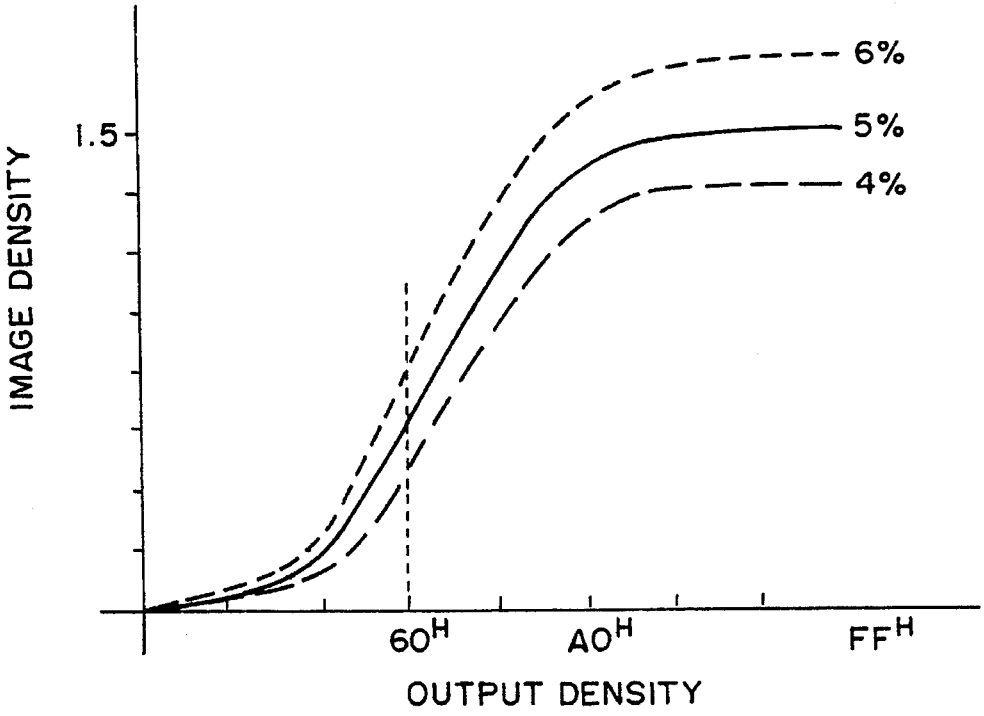
FIG. 7 is a graph showing the output image density as a function of the input image density when a carbon-containing toner is used and a rectangular wave (8 KHz, 2 KVpp) is used as a development bias.
Figure 9:
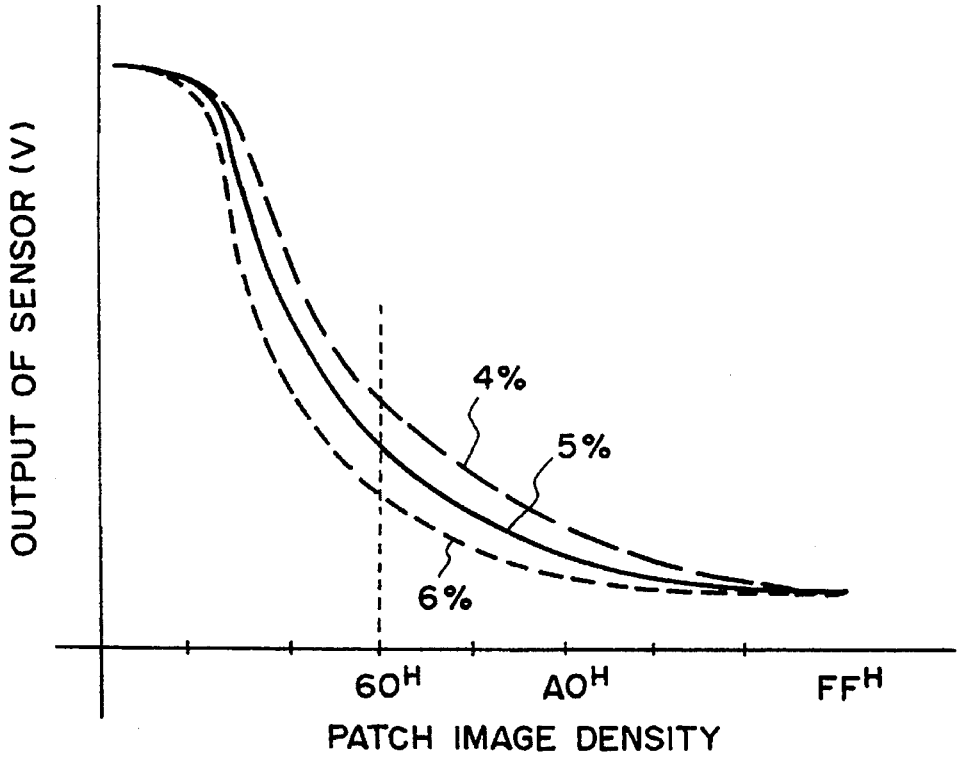
FIG. 9 is a graph showing the output from a density sensor as a function of the output image density when a carbon-containing toner is used and the rectangular wave (8 KHz, 2 KVpp) is used as a development bias.

KVpp as an AC component. The resulting characteristics are shown in FIGS. 7 and 9. FIG. 7 is a graph showing the output image density as a function of the input image density. When the frequency of the rectangular wave is increased, a high gradation level can no longer be obtained. However, the output from the density sensor as shown in FIG. 9 can be obtained; that is, the sensitivity at which the developing agent density is sensed is approximately 200 mV/wt % at a medium density. When this bias waveform was used as a development bias for forming a patch image for developing agent density control, the developing agent density variation decreased, and scattering and fog of the toner also decreased.

As described above, the developing agent density can be stabilized by performing switching between the image bias for the image formation and that for the formation of the developing agent density control patch image by using the two development biases. This further stabilizes the image density and also reduces scattering and fog of the toner.

Embodiment 3

As a development bias for developing a patch image for developing agent density control, a waveform in which an alternating field was intermittently generated as shown in FIG. 10, i.e., a waveform with a total frequency of 2.66 KHz, a rectangular part of 8 KHz, a blank part of 250 μsec, and a peak-to-peak voltage of 2 KVpp was used.

Figure 11:
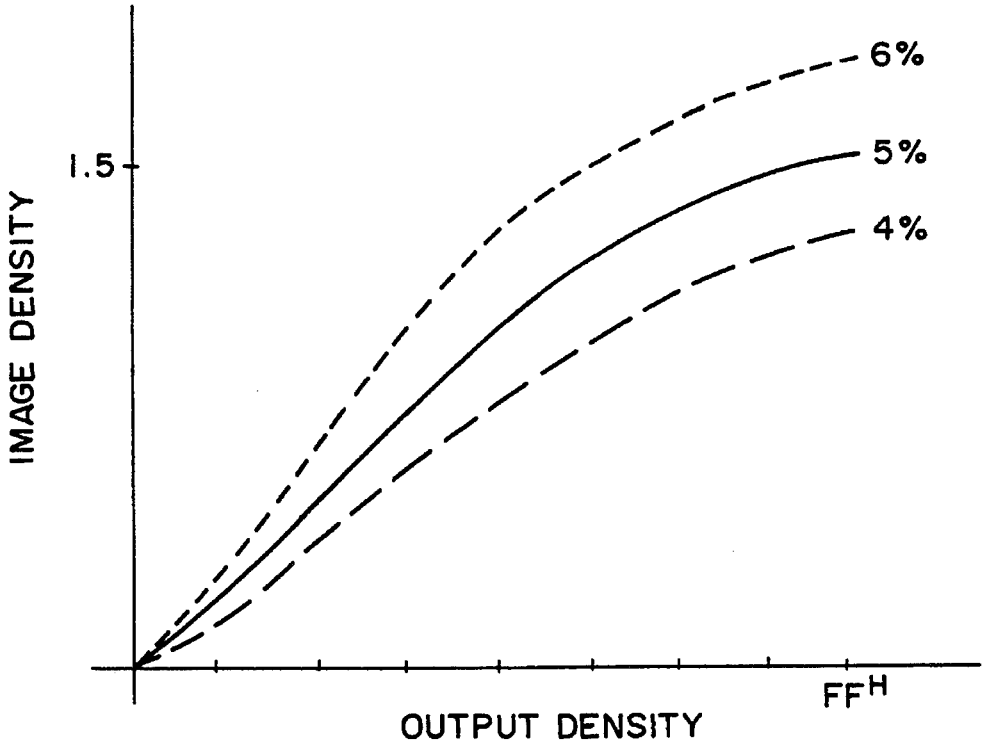
FIG. 11 is a graph showing the image density as a function of the input image density when a carbon-containing toner is used and a waveform which intermittently forms an alternating field is used as a development bias.
Figure 12:
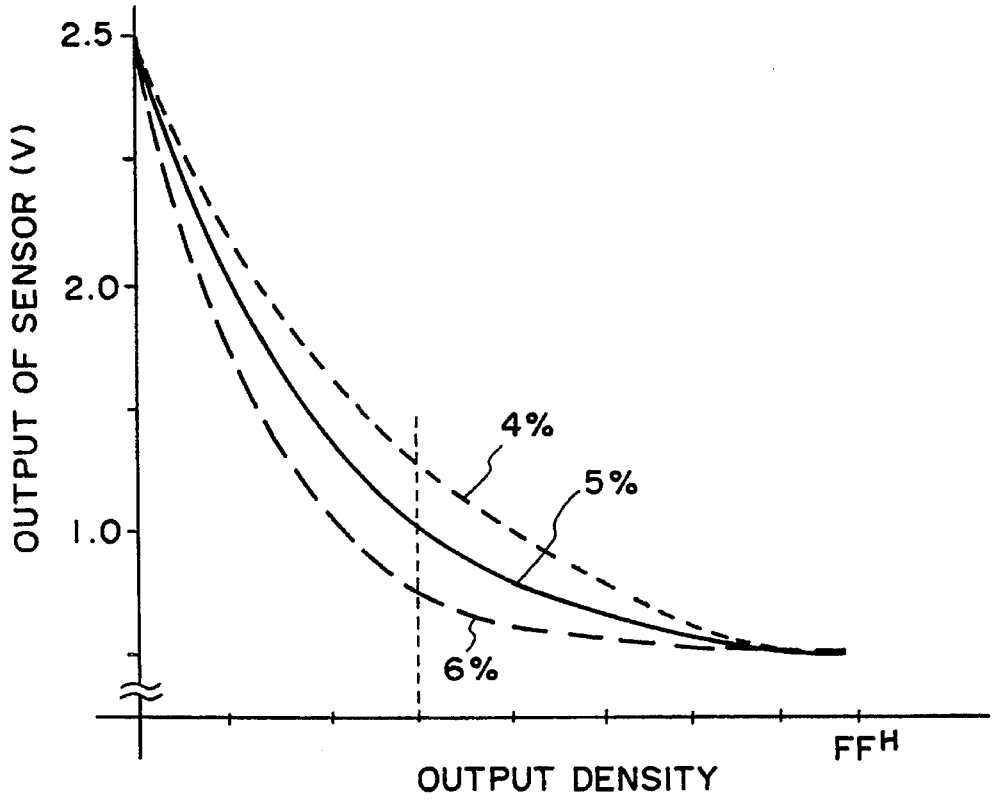
FIG. 12 is a graph showing the output from a density sensor as a function of the output image density when a carbon-containing toner and a waveform which intermittently forms an alternating field are used.

When the waveform in which an alternating field was generated intermittently was used as the development bias, the development efficiency increased to permit development at a low contrast. Consequently, it is possible to obtain a maximum density of 1.5 by a voltage that is about 100 V lower than a contrast potential required to obtain this maximum density when a normal rectangular waveform (2 KHz, 2 KVpp) is used. In addition, the characteristics as shown in FIGS. 11 and 12 are obtained. These characteristics were obtained when the black toner containing carbon was used.

FIG. 11 is a graph showing the output image density as a function of the input image density. It is apparent from the graph shown in FIG. 11 that the output image density largely changes in accordance with the change in developing agent density. This is also apparent in the density sensor output illustrated in FIG. 12.

It was found from the above results that the sensitivity at which the developing agent density was sensed in this embodiment was about 240 mV/wt %. This demonstrates that the waveform used in this embodiment was more suitable as the development bias for forming the patch image for developing agent density control than the normal rectangular wave (2 KHz, 2 KVpp) shown in FIG. 8 by which a sensitivity of about 140 mV/wt % was obtained.

Figure 13:
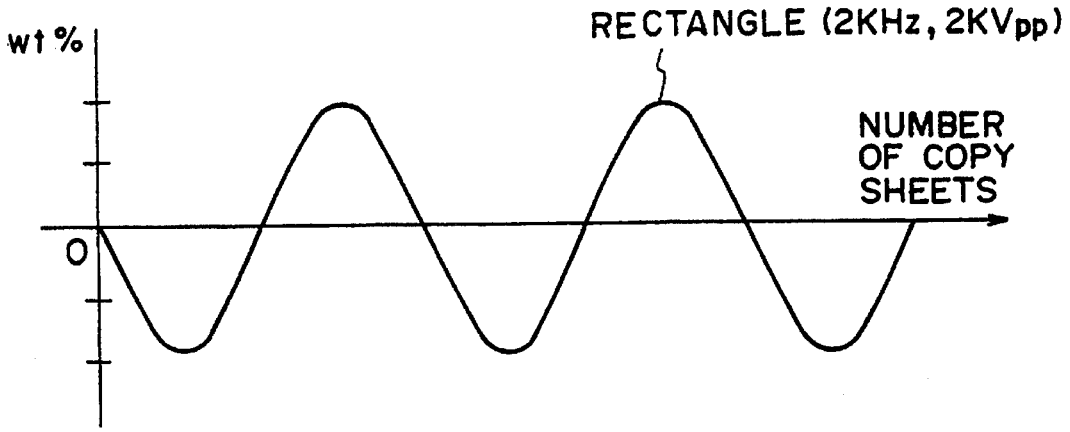
FIG. 13 is a graph showing the variation in developing agent density when a rectangular wave (2 KHz, 2 KVpp) is used as a development bias.
Figure 14:
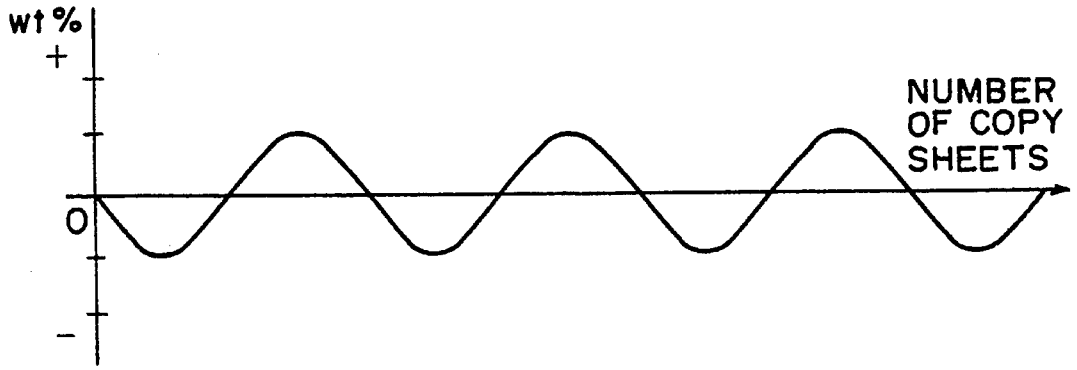
FIG. 14 is a graph showing the variation in developing agent density when a waveform shown in FIG. 10 is used as a development bias.

The present inventors conducted experiments using the waveform shown in FIG. 10 under the same conditions as when the developing agent density variation shown in FIG. 13 was obtained by the normal rectangular waveform (2 KHz, 2 KVpp). The result was that the developing agent density variation decreased as shown in FIG. 14.

As described above, the developing agent density can be stabilized by using two different development biases such that a rectangular wave of 2 KHz and 2 KVpp is used in the regular image formation and a waveform shown in FIG. 10 is used in the patch image formation. This also reduces scattering and fog of the toner.

The developing agent density control method according to the present invention uses the development bias for forming a patch image for developing agent density control, which is different from the development bias for regular image formation. That is, as the development bias for forming a patch image for developing agent density control, the method of the present invention uses a development bias having a frequency higher than that of the development bias for normal image formation, or a development bias in which an alternating field is formed intermittently. This reduces the developing agent density variation, resulting in reduced scattering and fog of the toner.

Although the preferred embodiments of the present invention have been described above, the present invention is not limited to these embodiments but can be modified without departing from the spirit and scope of the invention.

What is claimed is:

1. A developing agent density control method comprising the steps of:

forming a density control latent image with a predetermined potential on an image carrier;

developing the density control latent image by applying a density control development bias and using a two-component developing agent having a toner and a carrier;

sensing a density of the density control image; and controlling a toner-to-carrier ratio on the basis of the sensed density, wherein the density control development bias causes a larger variation in output image density with respect to a variation in the toner-to-carrier ratio than that caused by a print development bias.

2. A method according to claim 1, wherein the toner is a black toner containing carbon.

3. A method according to claim 1, wherein the density control latent image is a patch image.

4. A developing agent density control method comprising the steps of:

forming a density control latent image with a predetermined potential on an image carrier;

developing the density control latent image by applying a density control development bias and using a two-component developing agent having a toner and a carrier;

sensing a density of the density control image; and controlling a toner-to-carrier ratio on the basis of the sensed density, wherein a frequency of the density control development bias is higher than that of a print development bias.

5. A method according to claim 4, wherein the toner is a black toner containing carbon.

6. A method according to claim 4, wherein the density control latent image is a patch image.

* * * * *

UNITED STATES PATENT AND TRADEMARK OFFICE

CERTIFICATE OF CORRECTION

PATENT NO. : 5,469,244

DATED : November 21, 1995

INVENTOR(S) : TAKAO OGATA, ET AL.

It is certified that error appears in the above-indentified patent and that said Letters Patent is hereby corrected as shown below:

Column 3

Line 50, "idensity" should read --density--.

Signed and Sealed this

Twentieth Day of February, 1996

*Attest:*

*Attesting Officer*

BRUCE LEHMAN

*Commissioner of Patents and Trademarks*